US007707953B2

(12) United States Patent
Hillenbrand et al.

(10) Patent No.: US 7,707,953 B2
(45) Date of Patent: May 4, 2010

(54) GRIPPER DEVICE FOR TUFTING MACHINE

(75) Inventors: Bernd Hillenbrand, Albstadt (DE); Hans Werner Moser, Obernheim (DE); Andrea Maute, Albstadt (DE); Roland Wäschle, Albstadt (DE); Timo Kaas, Balingen (DE)

(73) Assignee: Groz-Beckert KG, Albstadt (DE)

( * ) Notice: Subject to any disclaimer, the term of this patent is extended or adjusted under 35 U.S.C. 154(b) by 575 days.

(21) Appl. No.: 11/709,803

(22) Filed: Feb. 23, 2007

(65) Prior Publication Data

US 2007/0200286 A1 Aug. 30, 2007

(30) Foreign Application Priority Data

Feb. 24, 2006 (EP) ..... 06003769

(51) Int. Cl.
*D05C 15/24* (2006.01)
*D05C 15/22* (2006.01)

(52) U.S. Cl. ..... 112/80.55

(58) Field of Classification Search ..... 112/80.5, 112/80.51, 80.52, 80.54, 80.55, 80.56, 80.7, 112/80.71

See application file for complete search history.

(56) References Cited

U.S. PATENT DOCUMENTS

| | | | | | |
|---|---|---|---|---|---|
| 2,990,792 | A * | 7/1961 | Nowicki et al. | ..... | 112/80.52 |
| 4,029,029 | A * | 6/1977 | Franks et al. | ..... | 112/80.53 |
| 4,155,318 | A | 5/1979 | Yamamoto | | |
| 4,185,569 | A | 1/1980 | Inman | | |
| 4,397,249 | A * | 8/1983 | Slattery | ..... | 112/80.55 |
| 4,466,366 | A | 8/1984 | Hirotsu | | |
| 4,522,132 | A * | 6/1985 | Slattery | ..... | 112/80.51 |
| 4,557,209 | A * | 12/1985 | Watkins | ..... | 112/80.3 |
| 5,738,027 | A * | 4/1998 | White | ..... | 112/80.55 |
| 7,007,617 | B2 * | 3/2006 | Johnston | ..... | 112/80.51 |

FOREIGN PATENT DOCUMENTS

| | | |
|---|---|---|
| JP | 58-144162 | 8/1983 |
| JP | S61-35303 | 8/1986 |
| JP | 62-028457 | 2/1987 |
| JP | H06-35703 | 5/1994 |
| WO | WO 01/20069 | 3/2001 |

* cited by examiner

*Primary Examiner*—Ismael Izaguirre
(74) *Attorney, Agent, or Firm*—Fitch, Even, Tabin & Flannery; Norman N. Kunitz

(57) ABSTRACT

The inventive gripper device for a tufting machine comprises a gripper device (10). The gripper device contains a gripper (11) and a guide member (12) that has a cutting edge. The gripper (11) has two gripper sections that are at a distance from each other in the direction of movement and are preferably separated from each other by a step (33) and/or by an extension (34), said gripper sections being configured as gripper edges that are parallel to each other, but spaced apart and offset with respect to each other in view of the pile height direction. The reversal between cut pile operating mode and looped pile operating mode takes place by means of the longitudinal adjustment of the gripper (11).

13 Claims, 6 Drawing Sheets

Figures 1, 1A:
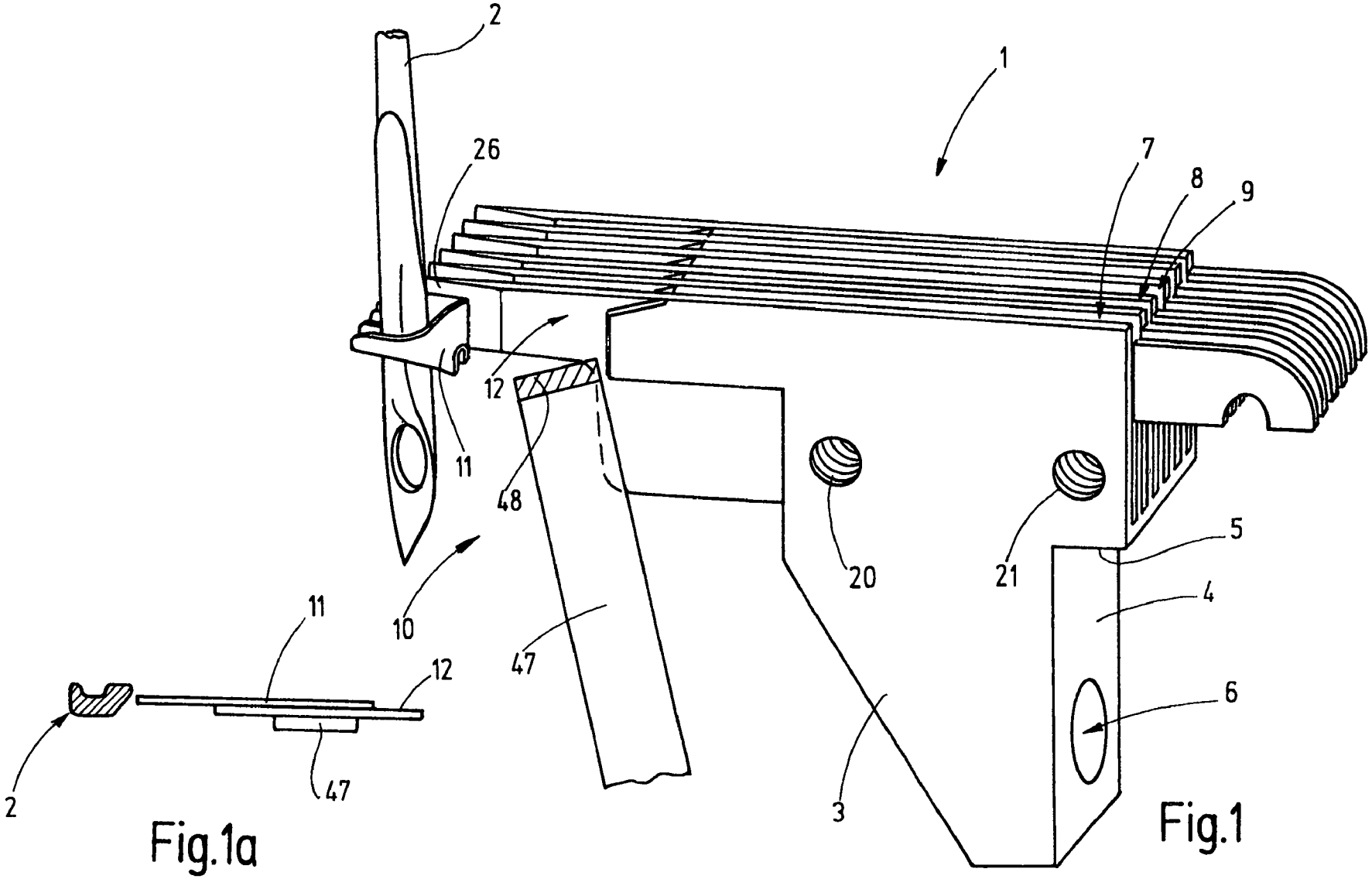

12
13
14
15
16
17
18
19
22
23
24
25
26
27
28
11
29
30
31
32
33
34
35
36
37
38
39
40
41

GRIPPER DEVICE FOR TUFTING MACHINE

This Application is a U.S. Utility Patent Application which claims priority from European Application No. 06 003 769.4, filed Feb. 24, 2006, the complete disclosure of which is incorporated herein by reference.

The invention relates to a gripper device for tufting machines as are used, in particular, in carpet manufacturing.

Frequently, tufting processes are used in the manufacture of carpets. Referring to such tufting methods, a flat support material (so-called "backing") is provided with a pile. The pile consists of a large number of individual pieces of yarn which are punched by tufting needles—row by row—through the backing. In so doing, the backing is gradually advanced stitch by stitch underneath a row of needles. The thusly formed loops are temporarily held by a gripper in order to be maintained during the reverse stroke of the needles. If the loops remain unharmed, looped pile is formed. If the loops are cut, cut pile is formed.

In order to produce structured carpets having a pattern, it is frequently desirable to use one and the same machine, to be able to produce—possibly by enabling appropriate knives and grippers—uncut, as well as cut, loops, i.e., to be able to create looped pile, as well as cut pile. Referring to this, U.S. Pat. No. 4,185,569 discloses a tufting machine comprising a loop gripper having a closing member. This closing member is pivotally supported on the loop gripper, whereby, in a first pivot position, said closing member—together with the gripper—defining an internal gripper space that is closed toward the outside. In a second pivot position, said closing member is pivoted away by a free end of the gripper, in order to thus clear an entrance into the internal space. In its internal space, the gripper has a straight cutting edge, which is disposed to be able to cut picked up loops by means of a knife in order to be able to produce cut pile. On its reverse side, the closing member is provided with a flat cutout that accepts loops which are not to be cut. The closing member can be adjusted by means of an adjustment device in such a manner that the entrance into the internal gripper space is cleared or not, so that the loops either move into this internal space or (if the entrance is not cleared) are temporarily picked up by the closing member. In the first case, the loops are cut on the cutting edge of the gripper. Cut pile is being created. In the second case, the loops are held by the gripper and then thrown off. Looped pile is being created.

Referring to this gripper device, the target-specific production of cut pile and of looped pile on the same backing and in alternating sequence is possible. However, pile damage may occur when the pile yarn is pinched between the closing member and the gripper. Furthermore, the gripper interacts with the needle, on the one hand, and with the knife, on the other hand. If the gripper is too hard, it wears out the needle. If it is too soft, it is worn down by the knife. It is difficult to find a compromise. If the yarn tension is centrally pre-specified, the configuration of the gripper and the closing member, as well as the size of the cut pile and the size of the looped pile, are pre-specified. Different pile sizes are formed, which can result in undesirable differences of pile height during the alternation between looped and cut pile in the same carpet.

Considering this, it is the object of the invention to eliminate one or more of the aforementioned difficulties.

This object is attained with the gripper device in accordance with the invention:

In accordance with the invention, the gripper device comprises a gripper that is divided into two sections. A first gripper section is used to produce looped pile. This gripper section picks up the loops in looped pile mode. A second gripper section is used to produce cut pile. It picks up the loops in cut pile mode. Consequently, the loops are held by the gripper during the operating cycle that is decisive in terms of defining loop size, i.e., during the return stroke of the needles, whereby the gripper section for the looped pile and the gripper section for the cut pile can be respectively located in such a position relative to the gripper that the desired pile height is produced. The height offset is measured at a right angle with respect to the gripper edges. The gripper sections may be arranged on, or provided on, the gripper relative to each other, i.e., offset, or not offset, with respect to height. In so doing, differences in pile height, which result in the production of cut pile by cutting the loops, can be compensated for. It is possible to manufacture carpets, in which the pile height of the looped pile and the pile height of the cut pile are the same, and also carpets, in which the cut pile is higher or even lower than the looped pile.

The gripper edges of the two gripper sections are preferably straight and are located on a common (vertical) plane. Furthermore, referring to an advantageous embodiment, said gripper sections are arranged parallel to each other, and are offset with respect to each other in longitudinal direction of the gripper edges, as well as in pile height direction. Furthermore, the gripper edges are preferably arranged parallel to an adjustment device of the gripper opposite the modular block which supports or holds the gripper. In so doing, the gripper sections are arranged relative to each other, preferably at a distance, in particular at a distance measured in longitudinal direction of the gripper edges. They may be separated from each other by a step. In addition, this step may have a projection that is also referred to as the gripper hook. This projection is disposed to prevent the pile yarn from inadvertently sliding from one gripper section onto the other.

The gripper edges are preferably rounded transversely to their longitudinal direction and are thus blunt to the extent that a pile yarn sliding along the gripper edge is not harmed. This careful handling of the pile yarn results in the high quality of the looped pile that is to be produced.

Preferably, the gripper is adjustably supported on a guide member, whereby said gripper is connected to an adjustment unit. By means of the adjustment unit, the gripper can be moved into a retracted position, in which it is activated—via its first gripper section—to produce the looped pile. In addition, the adjustment unit can be used to position said gripper in an forward position, which is at a distance from said gripper's free end and is located behind said gripper's step or behind said gripper's hook, so that the loops are no longer thrown off, but are moved to a cutting edge. The cutting edge may be provided on the guide member that is associated with a knife. By providing the cutting edge on the guide member it has been advantageously achieved that the gripper only comes into frictional contact with the tufting needle, but not with the knife. In view of its wear characteristics, the gripper can thus be adjusted to the interaction with the tufting needle. In contrast, the guide member can be adjusted—regarding its material and wear characteristics—to the knife. Consequently, the gripper and the guide member can each be made in one piece, and without any seams, of any optimal material, for example, softer steel for the gripper and harder steel for the guide member.

Several guide members together may be set in one module. In so doing, it is possible to arrange the guide members interchangeably or to hold them in the module joined in a material-to-material manner. For example, this can be achieved by cementing, casting—in case of metal or non-metal materials, by soldering, etc. It is also possible to mount the guide members directly to the bar of a tufting machine.

Additional details of advantageous embodiments or developments of the invention are the subject matter of the drawings, the description or of the claims.

The drawings show an exemplary embodiment of the invention. They show in

Figures 2, 3:
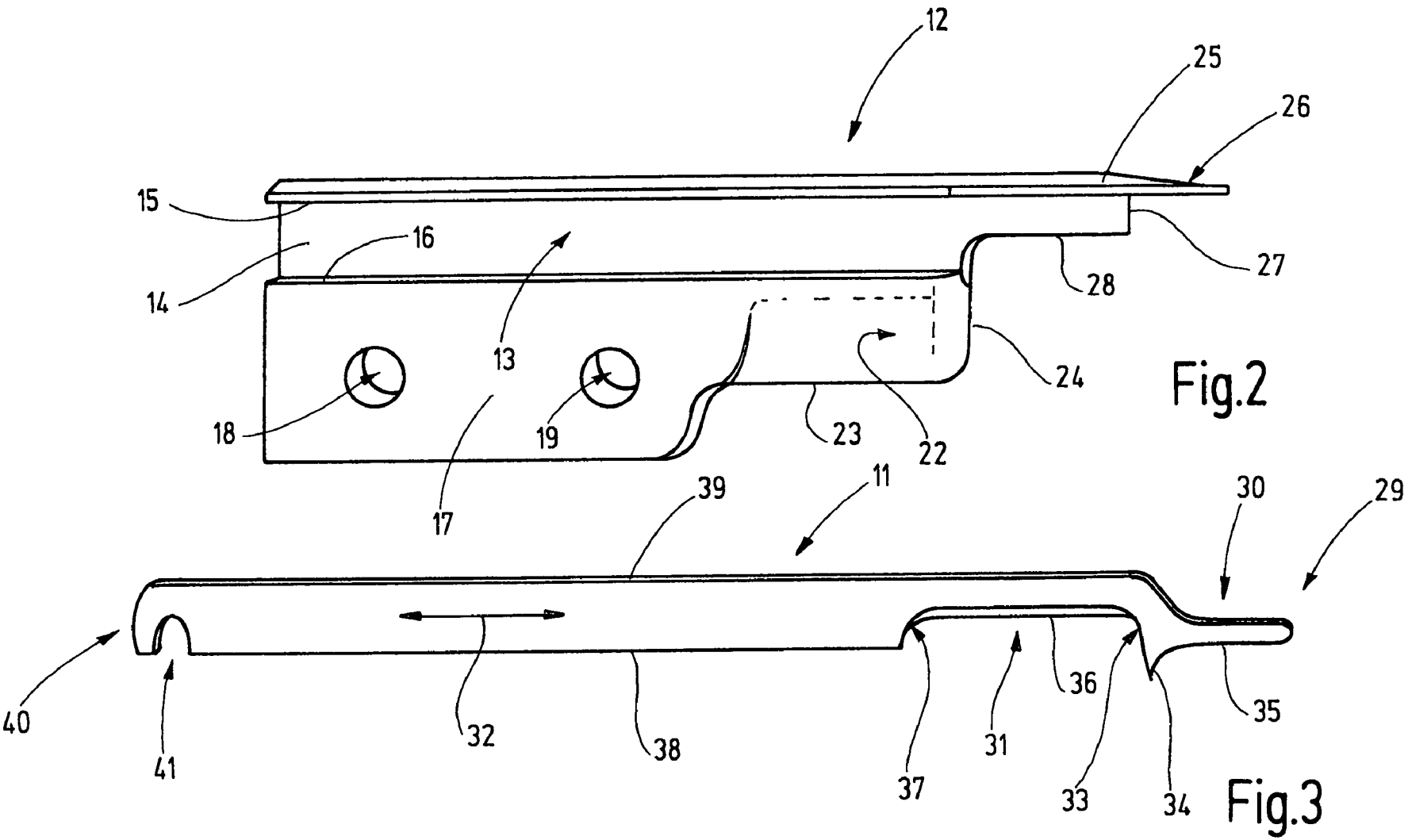
Figure 4:
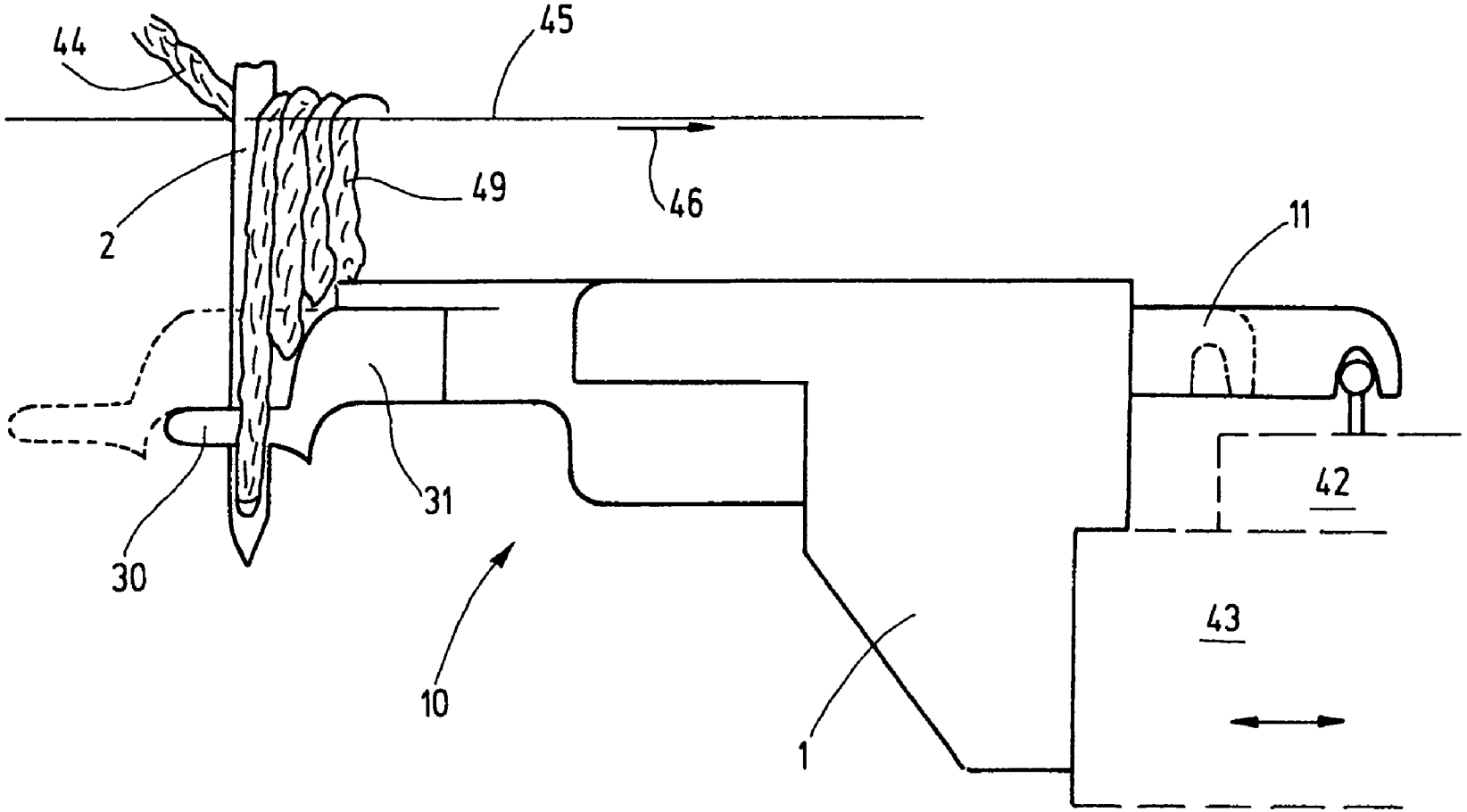
Figure 5:
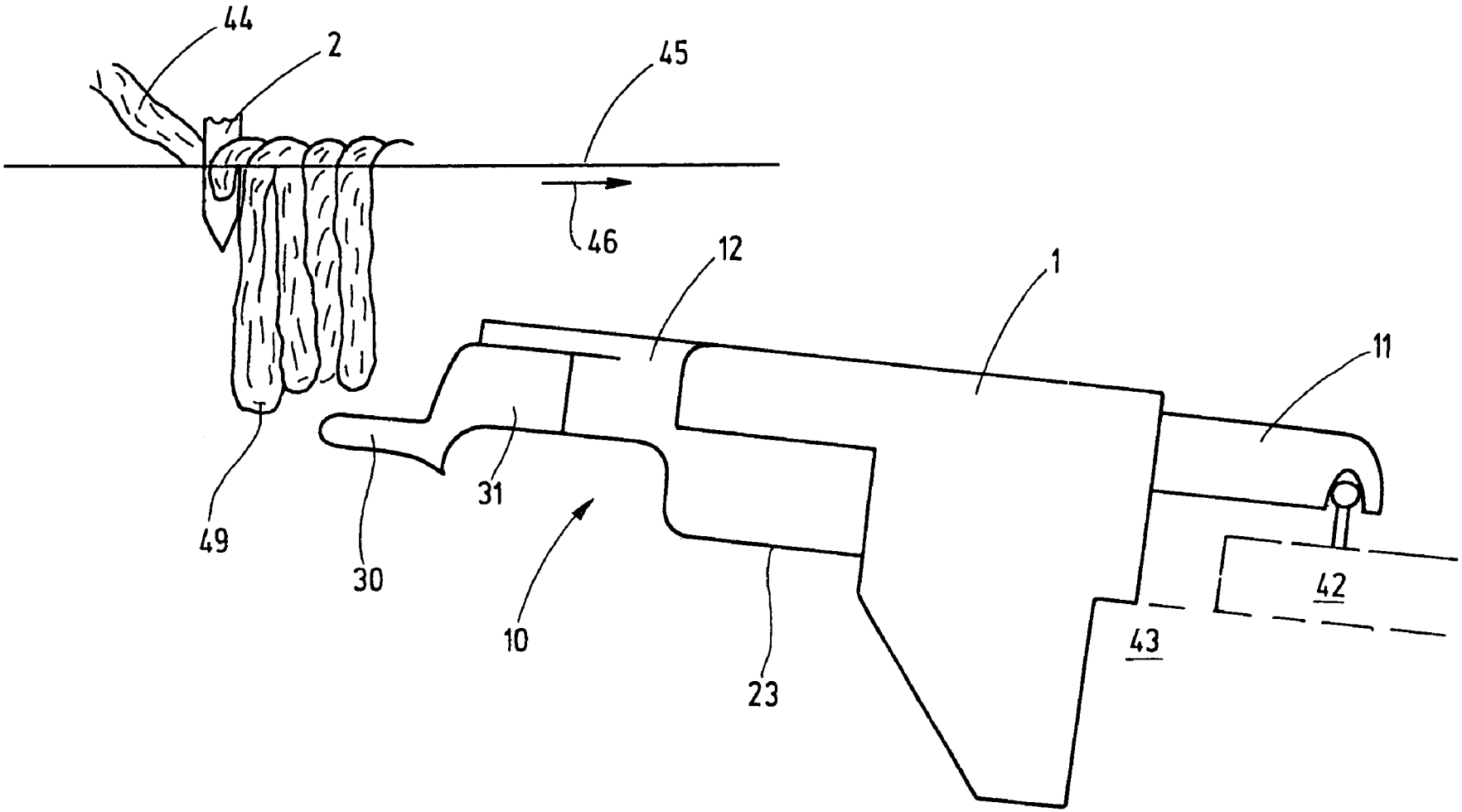
Figure 6:
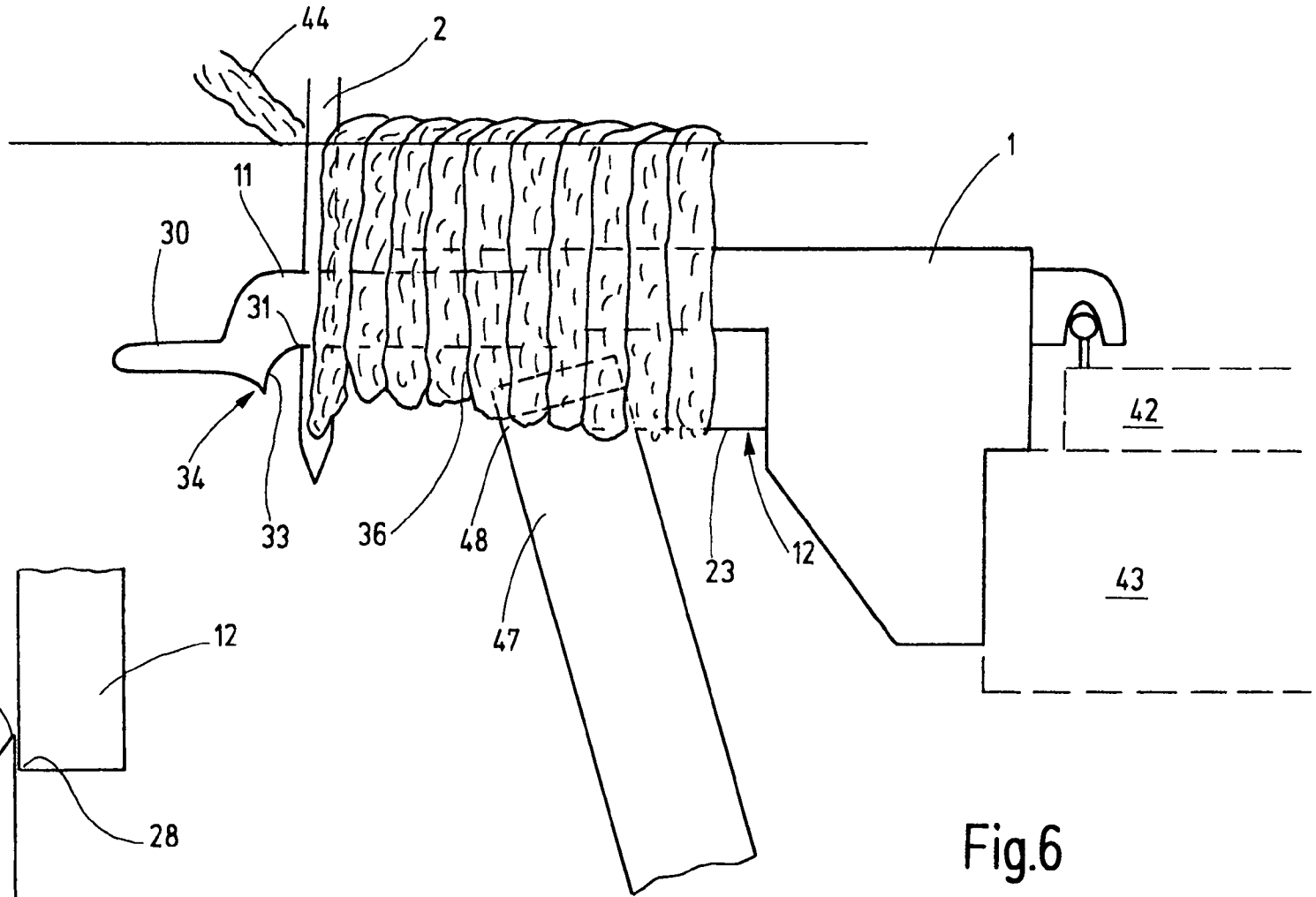
Figure 6A:
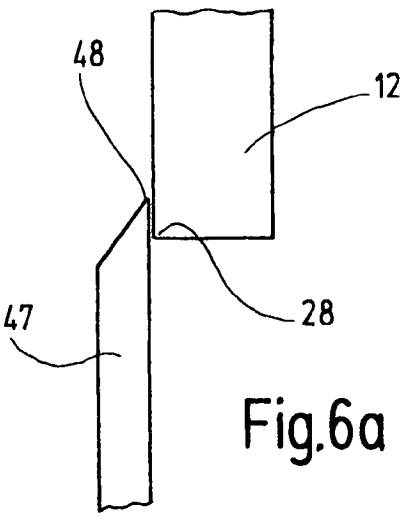
Figure 7:
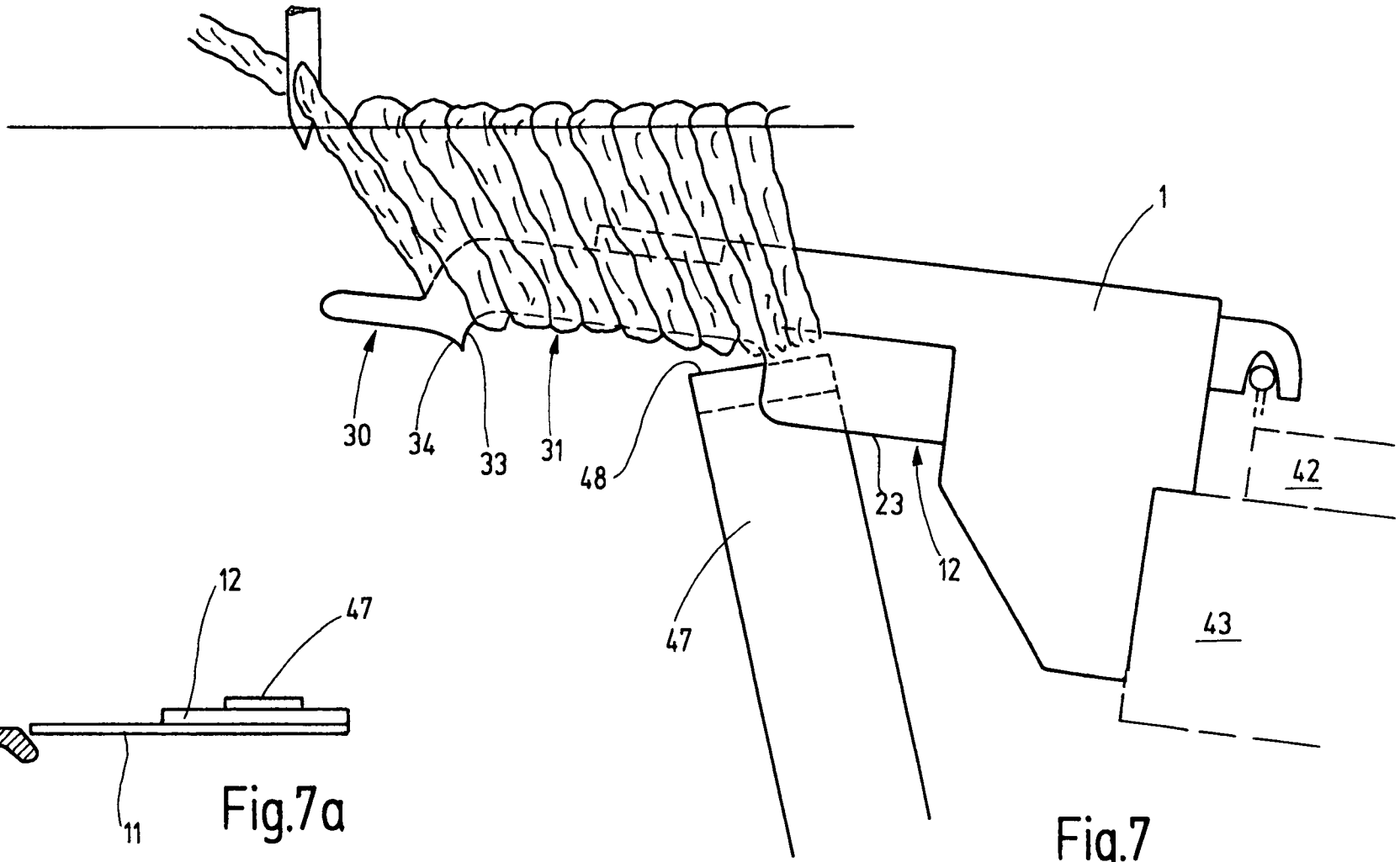
Figure 7A:
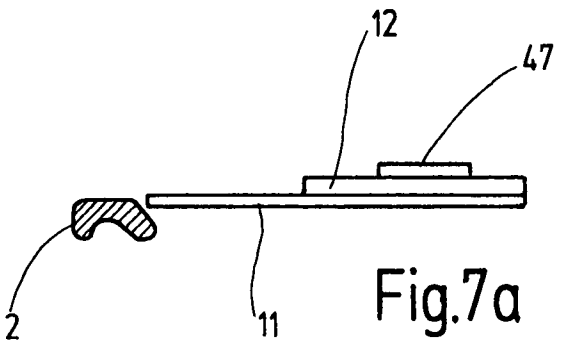

FIG. 1 a perspective illustration of a tufting needle and of a modular block of a tufting device;

FIG. 1*a* a highly simplified plan view of the arrangement of a gripper device relative to the L-tufting needle;

FIG. 2 a perspective view of a guide member for the modular block in accordance with FIG. 1;

FIG. 3 a perspective illustration of a gripper for the modular block in accordance with FIG. 1;

FIG. 4 a schematic side view of the modular block with the guide member and the gripper in a first operating mode in an operative position when a pile loop is being picked up;

FIG. 5 the device in accordance with FIG. 4 in the first operating mode when the loop is being thrown off while the looped pile is being produced;

FIGS. 6 and 7 different schematic views of operative positions of the modular block in accordance with FIG. 1, comprising a gripper device that is a mirror image—with respect to a vertical plane—of the configuration in accordance with FIG. 1, in a second mode of operation with said gripper pushed forward in order to produce cut pile;

FIG. 6*a* a detail of a part of the side view of FIGS. 6 and 7; and, FIG. 7*a* a highly simplified plan view of the arrangement of a gripper device relative to the tufting needle, with an R-tufting needle.

FIG. 1 shows a modular block 1 associated with a tufting machine, a larger number of such blocks being used in a tufting machine. Such modular blocks are mounted next to each other to a bar that extends in a direction transverse to the direction of movement of the carpet to be manufactured, and preferably extends under said carpet. In addition, the tufting machine comprises a bar with tufting needles, one of these tufting needles 2 being shown in FIG. 1. These needles are used to punch pile yarn through the backing. The modular blocks are disposed to hold the thusly produced loops and release them unharmed or, optionally, cut said loops.

The modular block 1 comprises a base body 3 having abutment surfaces 4, 5, which are assigned to the bar. A bore 6 is used to mount the modular block 1 to the bar.

On its side facing the backing (FIG. 1, top), the modular block is provided with grooves 7, 8, 9 that are in parallel alignment with respect to each other and, in which case, respectively one gripper device 10 is seated in said grooves. Each gripper device 10 consists of a gripper 11 and of a guide member 12. Whenever the guide member 12 is immovably connected to the modular body 3, the gripper 11 can be moved against the guide member 12 and thus against the modular block 1. In the preferred exemplary embodiment, the gripper 11 is supported such that it can be shifted in linear direction against the guide member 12.

FIG. 1 and FIG. 1*a* show a knife 47 that has a cutting edge 48 and interacts with the guide member 12—as will be explained later—in order to produce cut pile. The guide member 12 and the knife 47 form a cutting device. The tufting needle shown in FIG. 1*a* is an L-tufting needle, i.e., its chamfer is on left side when the groove of the needle faces downward, i.e., on the right side of FIG. 1*a*.

FIGS. 2 and 3 show the gripper 11 and the guide member 12 in a perspective opposite the viewing direction of FIG. 1. The guide member 12 extends from a flat body having a substantially uniform thickness, whereby this thickness corresponds approximately to the width of one of the grooves 7 through 9. An upper section has a flat, wide groove 13 that extends along the entire length of the guide member 12, said groove preferably having a plane groove bottom 14 and two parallel flanks 15, 16 facing each other. The groove 13 represents a guide for the gripper 11, said gripper having a cross-section that substantially corresponds to the cross-section of the groove 13 in such a manner that said gripper is held in an easily movable manner, and with minimal play, in longitudinal direction of the groove parallel to the groove bottom 14 and to the flanks 15, 16.

Underneath the groove 13, the guide member 12 has a holding section 17 that is provided with two bores 18, 19. The bores 18, 19 are in alignment with corresponding bores 20, 21, which are provided in the modular body 3 and which extend through the grooves 7, 8, 9.

Adjoining the holding section 17, below the groove 13, is a section 22, which can have the shape of a wedge such that said section has an edge 23 aligned parallel to the groove 13. The edge 23 is preferably inclined at an acute angle with respect to the groove 13. The free space created by the arrangement of the section 22 at an acute angle is necessary to permit the knife 47 of the adjacent gripper device 10, which is arranged diagonally with respect to the guide member 12, to perform its advance movement without collision. The diagonal arrangement of the knife 47 helps to create sufficient force for the cutting operation. The section 22 is essentially limited in a rectangular direction. Said section may have on its front end—away from the holding section 17—an edge 24 that is aligned at a right angle with respect to the groove 13. Alternatively, the edge 24 may be aligned diagonally with respect to the groove 13.

Above the edge 24, the guide member 12 is cut out in such a manner that only an upper portion of the groove bottom 14 and the flank 15 remain. The flank 16 is missing in this region. An upper edge 25, which forms the flank 15 on the groove side, ends in a wedge 26 on the end side. Due to the wedge-shaped chamfer at the end of the guide member 12, the groove bottom 14 ends in a more or less sharp edge 27. The cutting edge 28 is formed by the border or the edge 28 of the groove bottom 14, said border or said edge extending at a right angle thereto. The cutting edge 28 is formed by the groove bottom 14 and by an edge 50 (FIG. 6*a*), said cutting edge being arranged at an angle $\alpha$ of 90 degrees with respect to said groove bottom and being oriented parallel to the flank 16. As is obvious from FIGS. 6 and 7, the rear side of the guide member 12 forms the abutment surface for the knife 47 in the region of the cutting edge 28. The cutting angle $\alpha$ may be varied as a function of the location of the edge 50. An arrangement of the edge 50 at a 90-degree angle with respect to the cutting edge 28, results in a cutting angle of 0 degrees. An arrangement of the edge 50 at an angle smaller than 90 degrees results in an acute angle of the cutting edge 28.

The gripper 11 is designed as a slider, which has, on its end 29, a first gripper section 30 for picking up loops and, at a distance therefrom, a second gripper section 31. The gripper sections 30, 31 are preferably arranged at a distance with respect to one direction of movement, said direction being indicated by an arrow 32 in FIG. 1 and being pre-specified by the longitudinal groove direction of the groove 13. Furthermore, a step 33 is preferably provided between the gripper sections 30, 31. In addition, this step may end in an extension 34 that is also referred to as a hook. The step 33 and the extension 34 prevent an undesired transfer of a loop from one gripper section 30, 31 to the other.

Each of the gripper sections 30, 31 has—on the same side of the gripper 11 (in FIG. 1 on the lower side)—a gripper edge 35, 36 that is designed to hold the pile yarn loops. The gripper edges 35, 36 are straight in the direction of movement (arrow 32) and parallel thereto. However, these gripper edges are curved or rounded in lateral direction in order to not harm the pile yarn of the picked up loop. In addition, the gripper edges 35, 36 are rounded on the end 29, on the hook 34, on the step 33, as well as on the edge end 37 of the gripper edge 36. Moreover, the gripper 11, which is to be set like a slider in the groove 13, is limited by the straight narrow sides 38, 39, between which said gripper has essentially plane flat sides. On its end 29 away from the end 40, the gripper 11 is provided with a cutout 41 that is used for the attachment of an adjustment unit 42, as schematically indicated in FIG. 4. This adjustment unit may be seated on a schematically indicated bar 43 that also supports the modular block 1.

The gripper device 10 described so far operates as follows:

In a first mode of operation as illustrated by FIGS. 4 and 5, the modular block 1 and the gripper device 10 are used to produce a carpet with looped pile. To achieve this, each tufting needle 2 of the needle bar punches one pile yarn 44 through the backing 45, in which case the tufting needles 2 are congruently arranged behind each other, as in FIG. 4. Applications using so-called staggered modules are also known. These comprise two rows of tufting needles 2, which are spaced apart, and in which case the tufting needles of each row, again, are congruently arranged behind each other. The adjustment unit 42 is used for the selection of the gripper 11 in order to produce looped pile and/or cut pile. This means that, within a module 1, each gripper 11 can be controlled individually by the adjustment unit 42. Within the range of a module 1, it is possible to produce loop goods, as well as velour goods. In order to produce looped pile, the adjustment unit 42 adjusts the gripper 11 in its retracted position in accordance with FIG. 4. The gripper 11 remains in this position with respect to the modular block 1 during the entire tufting operation for the production of looped pile. FIG. 4 shows an example of a tufting machine, in which the gripper 11 is set against the direction of movement of the backing 45, as indicated by an arrow 46. Once the tufting needle 2 has punched the pile yarn 44 through the backing 45, the bar 43 is moved, so that the gripper section 30 of the gripper 11 punches between the tufting needle 2 and the pile yarn 44. As long as the tufting needle 2 is retracted, the bar 43 remains in the position as illustrated in FIG. 4, so that the forming loop is held in place.

During the next step the bar 43 in FIG. 4 is moved to the right, so that the gripper section 30 throws off the just now still retained loop 49, as illustrated in FIG. 5. In so doing, the bar 43 can be moved in linear direction or, as illustrated, perform a pivoting movement. The backing 45 is advanced by one stitch width in the direction of the arrow 46, and the tufting needle 2 again begins—as illustrated—to punch the pile yarn 44 through the backing 45.

As a whole, this process repeats itself continuously, in which case—as long as looped pile is to be produced—the adjustment unit 42 holds the gripper 11 in its retracted position.

FIGS. 6 and 7 illustrate the operation of the above-described device for the production of cut pile. The adjustment unit 42 has shifted the gripper 11 into its forward position. Therefore, the gripper projects from the guide member 12 considerably farther than before. Referring to the axial direction of movement of the gripper 11, the gripper section 31 is now approximately at the point—with respect to the bar 43 or the modular block 1—at which the gripper section 30 was positioned beforehand, in accordance with FIGS. 4 and 5. Consequently, as is obvious from FIG. 6, when the loop is caught when the gripper 11 is inserted between the tufting needle 2 and the pile yarn 44, the gripper section 31 moves into the immediate vicinity of the tufting needle 2. Thus the forming stitch is held behind the step 33. If the needle 2 is retracted, this stitch cannot slide back onto the first gripper section 30. This also applies when the bar 43, as shown by FIG. 7, performs its return stroke. The step 33 and the projection 34 secure the loops on the gripper section 31.

During the subsequent operating sequences, the loops, as is again obvious from FIG. 6, gradually arrive on the guide member 12, whereby they move from the gripper edge 36 onto the cutting edge 28 of the guide member 12. This cutting edge 28 forms a cutting gap with the knife 47 and its cutting edge 48. The knife 47 may move onto the loops or stitches, so that the cutting gap is closed and the loop is cut. Thus, cut pile made of cut stitch loops is produced. So-called velour goods are being produced.

It is possible to switch between the operating modes of "production of looped pile" and "production of cut pile" by adjusting the gripper 11 in longitudinal direction with the use of the adjustment unit 42. This can be done individually for each gripper 11 of the bar 43. The bar 43 carries out uniform movements during the production of looped pile and during the production of cut pile. The extension 34 prevents the retracted gripper 11 from allowing loops of the gripper section 30 to move to the gripper section 31 or to the guide member 12. Such loops are thus protected from the knife 47. These loops move above the modular block 1 past said knife. In contrast, the pushed forward gripper 11 prevents the picked up loops from being thrown off, said loops being seated on the second gripper section 31 and being transported to the guide device 12 and its cutting edge 23. The cutting device consists of the guide member 12 and the knife 47.

As a result of the appropriate design of the height offset between the gripper edges 35, 36 as is shown by FIG. 3, the desired pile height (or pile length) can be individually adjusted separately for looped pile and for cut pile. Correspondingly, desired changes of the pile height and the pile height differences can be achieved by interchanging the gripper 11. In addition, the gripper 11 and the guide member 12—being wearing parts—can be replaced separately.

The inventive gripper device for a tufting machine comprises a gripper device 10. The gripper device 10 contains a gripper 11 and a guide member 12 that is provided with a cutting edge 23. The gripper 11 has two gripper sections 30, 31 that are at a distance from each other in the direction of movement and are preferably separated from each other by a step 33 and/or by an extension 34, said gripper sections being configured as gripper edges 35, 36 that are parallel to each other, but spaced apart and offset with respect to each other in view of the pile height direction. The reversal between cut pile operating mode and looped pile operating mode takes place by means of the longitudinal adjustment of the gripper 11.

LIST OF REFERENCE NUMBERS

1 Modular block (base body)
2 Tufting needle (L-tufting needle with left-side chamfer; R-tufting needle with right-side chamfer)
3 Modular body, base body
4, 5 Abutment surfaces
6 Bore
7, 8, 9 Grooves
10 Gripper device
11 Gripper
12 Guide member
13 Groove
14 Groove bottom

15, 16 Flanks
17 Holding section
18, 19, 20, 21 Bores
22 Section
23 Cutting edge
24 Edge
25 Border
26 Wedge
27 Edge
28 Edge/boundary
29 End
30, 31 Gripper section
32 Arrow
33 Step
34 Extension (hook)
35, 36 Gripper edges
37 Edge end
38, 39 Narrow sides
40 End
41 Cutout
42 Adjustment unit
43 Bar
44 Pile yarn
45 Backing
46 Arrow
47 Knife
48 Cutting edge
49 Loop

The invention claimed is:

1. Gripper device for tufting machines for the manufacture of carpets, comprising:

a gripper having a first gripper section for the production of looped pile and a second gripper section for the production of cut pile;

a guide member associated with the gripper, with the gripper being supported on the guide member and longitudinally moveable therein;

a cutting edge provided on the guide member; and, a knife associated with the cutting edge on the guide member.

2. Gripper device in accordance with claim 1, wherein the first gripper section has a straight gripper edge.

3. Gripper device in accordance with claim 1, wherein the second gripper section has a straight gripper edge.

4. Gripper device in accordance with claim 3, wherein the gripper edges are aligned parallel to each other.

5. Gripper device in accordance with claim 3, wherein the gripper edges are arranged offset with respect to each other, viewed in tufting needle punching direction.

6. Gripper device in accordance with claim 1, wherein the first gripper section and the second gripper section are at a distance from each other in a gripper adjustment direction.

7. Gripper device in accordance with claim 1, wherein the first gripper section and the second gripper section are separated from each other by a step.

8. Gripper device in accordance with claim 1, wherein an extension is formed between the first gripper section and the second gripper section.

9. Gripper device in accordance with claim 1, wherein the gripper is seamlessly made in one piece of one and the same material.

10. Gripper device in accordance with claim 1, wherein the gripper is made of a material exhibiting a wear resistance that is different from the wear resistance of the tufting needles.

11. Gripper device in accordance with claim 1, wherein the gripper has a cutout for an adjustment unit in order to adjust the position of the gripper with respect to the guide member.

12. Gripper device in accordance with claim 1, wherein the cutting edge is straight.

13. Gripper device in accordance with claim 1, wherein the guide member is made of a material exhibiting a wear resistance that is different from the wear resistance of the gripper.

* * * * *